US008315420B2

(12) United States Patent
Schneider et al.

(10) Patent No.: US 8,315,420 B2
(45) Date of Patent: Nov. 20, 2012

(54) SPIDER

(75) Inventors: Norman Adams Schneider, Medway, MA (US); Donald Baker, North Attleboro, MA (US)

(73) Assignee: Bose Corporation, Framingham, MA (US)

( * ) Notice: Subject to any disclaimer, the term of this patent is extended or adjusted under 35 U.S.C. 154(b) by 1586 days.

(21) Appl. No.: 11/680,358

(22) Filed: Feb. 28, 2007

(65) Prior Publication Data

US 2008/0205685 A1 Aug. 28, 2008

(51) Int. Cl.
*H04R 25/00* (2006.01)

(52) U.S. Cl. ..... 381/404; 381/403; 381/413; 381/426

(58) Field of Classification Search ..... 381/404
See application file for complete search history.

(56) References Cited

U.S. PATENT DOCUMENTS

| | | | | |
|---|---|---|---|---|
| 5,776,597 | A | 7/1998 | Watanabe et al. | |
| 6,626,262 | B1 * | 9/2003 | Chen | 181/149 |
| 2002/0112914 | A1 * | 8/2002 | Abe et al. | 181/166 |
| 2006/0249327 | A1 | 11/2006 | Sato et al. | |
| 2008/0205685 | A1 | 8/2008 | Schneider et al. | |
| 2009/0010471 | A1 * | 1/2009 | Okazaki et al. | 381/354 |

FOREIGN PATENT DOCUMENTS

| | | |
|---|---|---|
| EP | 1 233 644 | 8/2002 |
| EP | 1 411 747 | 4/2004 |
| EP | 1 788 839 | 5/2007 |
| JP | 55046679 | 4/1980 |
| JP | 55075397 | 6/1980 |
| JP | 56-064597 | 6/1981 |
| JP | 62-263799 | 11/1987 |
| JP | 03173299 | 7/1991 |
| JP | 03259699 | 11/1991 |
| JP | 05-022792 | 1/1993 |
| JP | 11-298993 | 10/1999 |
| JP | 2002-010390 | 1/2002 |
| JP | 2007-281637 | 10/2007 |

OTHER PUBLICATIONS

First CN Office Action dated Febraury 29, 2012 for Chinese Application No. 200880006432.6.
International Preliminary Report on Patentability dated Sep. 11, 2009 for PCT/US2008/054993.
Translation of JP 62-263799 recently provided by Inventor.
Steve Mowry, Another Spider Article, 2006, http://www.audioxpress.com/magsdirx/voxcoil/addenda/mowry206.pdf, downloaded Aug. 18, 2006.
Tatarunis and Klasco, An Epic Historical Perspective and a Look to the Future, http://home.comcast.net/~stevetat/Spider Article 4-04.doc, downloaded Sep. 7, 2006.
International Search Report and Written Opinion dated Jun. 30, 2008 from International Application No. PCT/US2008/054993.

* cited by examiner

*Primary Examiner* — Curtis Kuntz
*Assistant Examiner* — Jasmine Pritchard

(57) ABSTRACT

A spider for high-power, compact electro-acoustic transducers comprises a non-woven fiber blend encased in a thermoplastic elastomer. The spider is capable of supporting the longer stroke distances of the high-power, compact electro-acoustic transducers and exhibits improved fatigue and ageing resistance.

27 Claims, 3 Drawing Sheets

SPIDER

BACKGROUND OF THE INVENTION

The present invention relates to high performance, compact electro-acoustic transducers. More specifically, the invention relates to non-woven composite spiders used in these compact electro-acoustic transducers.

A spider and surround provide a suspension system for a diaphragm in an electro-acoustic transducer. Both the spider and surround support the diaphragm as it moves along the transducer axis and prevents a voice coil attached to the diaphragm from rubbing against or hitting the transducer's pole piece or pole plate. The spider and surround are typically ring-shaped having an inner and outer perimeter. The outer perimeters of the spider and surround are attached to the transducer's basket. The inner perimeter of the surround is typically attached to the outer edge of the diaphragm. The inner perimeter of the spider is typically attached near a narrow portion of the diaphragm or to a bobbin.

Spiders are typically made by dipping a woven fiber such as cotton in a phenolic resin. The woven cotton provides strength and fracture toughness to the spider and the phenolic resin provides enough stiffness to maintain the spider's shape while providing enough compliance to allow the diaphragm to freely move along the transducer axis. The phenolic resin coats the fibers and forms bridges between the warp and weft yarns where the yarns overlap. The resin bridges provide stiffness to the coated fiber while allowing air to pass through interstices between the woven fabric. The phenolic-resin-fiber-coated spider is herein referred to as the typical spider.

As the diaphragm moves in and out along the transducer axis, the spider is repeatedly flexed or stretched to accommodate the movement of the diaphragm. The repeated flexing/stretching of the spider typically leads to a fatigue-type failure, thereby shortening the life of the electro-acoustic transducer. Furthermore, the flexing/stretching of the spider generally reduces the stiffness of the spider over time (ageing), which may affect the acoustic properties of the electro-acoustic transducer.

Consumer pressure favors the design of high-power, compact electro-acoustic transducers, which usually requires longer stroke distances for the diaphragm. The longer stroke distance generates larger cyclic stresses in the spider and accelerates the ageing of the spider and shortens the live of the spider. Therefore, there remains a need for compact spiders that can support the longer stroke distances of the diaphragm with increased fatigue and ageing resistance.

SUMMARY OF THE INVENTION

A spider for high-power, compact electro-acoustic transducers comprises a non-woven fiber blend encased in a thermoplastic elastomer. The spider is capable of supporting the longer stroke distances of the high-power, compact electro-acoustic transducers and exhibits improved fatigue and ageing resistance.

One embodiment of the present invention is directed to a spider comprising a non-woven fiber mat embedded in an elastomeric matrix. In one aspect, the elastomeric matrix is impermeable to air. In one aspect, the elastomeric matrix is a polyurethane. In one aspect, the non-woven fiber mat is a polyester. In one aspect, the non-woven fiber mat is a fiber blend. In one aspect, the non-woven fiber is a blend of a polyester fiber and an aramid fiber. In one aspect, the fraction of aramid fiber in the fiber blend is between 0.1 and 0.9. In one aspect, the fraction of aramid fiber in fiber blend is between 0.4 and 0.6. In one aspect, the elastomeric matrix is selected from a group comprising a thermoplastic polyurethane, a two-part polyurethane, a silicone, a thermoplastic rubber, TPSiV, and combinations thereof. In one aspect, the non-woven fiber is selected from a group comprising a cotton, a polyester, a nylon, a cellulose, an aramid, a polyphenylene sulfide, a polyacrylonitrile, and combinations thereof. In one aspect, the fiber blend comprises polyester fiber and polyacrylonitrile fiber. In one aspect, the fiber blend comprises polyester fiber and polyphenylene sulfide fiber. In one aspect, the spider is vented. In one aspect, the spider has an elastomer-rich external surface Another embodiment of the present invention is directed to an electro-acoustic transducer comprising: a basket supporting a magnet; a diaphragm capable of movement relative to the basket, the diaphragm attached to a voice coil characterized by an axis, the voice coil generating a magnetic field in response to an input signal applied to the voice coil, the interaction of the generated magnetic field interacting with a magnet field of the magnet causing the diaphragm to move along the axis; a surround having a first perimeter attached to the basket and a second perimeter attached to the diaphragm at a first point along the axis; and a composite spider having a first portion attached to the basket and a second portion attached to the diaphragm at a second point along the axis, wherein the composite spider is impermeable to air. In one aspect, the composite spider comprises a non-woven fiber. In one aspect, the non-woven fiber is a polyester fiber. In one aspect, the non-woven fiber is a fiber blend. In one aspect, the non-woven fiber is a blend of a polyester fiber and an aramid fiber. In one aspect, the aramid fiber is a meta-aramid fiber. In one aspect, the aramid fiber is a para-aramid fiber. In one aspect, the composite spider comprises an elastomeric matrix. In one aspect, the elastomeric matrix is a polyurethane. In one aspect, the non-woven fiber blend comprises a polyester fiber and a polyacrylonitrile. In one aspect, the composite spider is vented. In one aspect, the composite spider is characterized by a fiber-rich interior volume between elastomer-rich volumes, the elastomer-rich volumes forming external surfaces of the composite spider.

BRIEF DESCRIPTION OF THE DRAWINGS

The invention will be described by reference to the preferred and alternative embodiments thereof in conjunction with the drawings in which like structures are referenced with like numbers.

DETAILED DESCRIPTION

Figure 1:
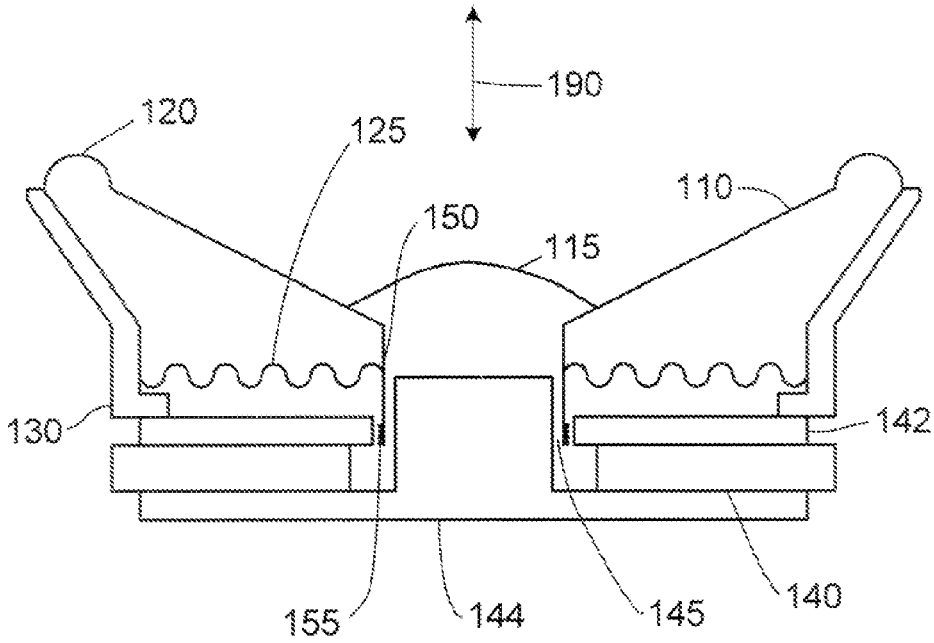
FIG. 1 is a sectional view of an embodiment of the present invention.

FIG. 1 is a sectional view of an embodiment of the present invention. In FIG. 1, diaphragm 110 is supported by a surround 120 and a spider 125. An outer edge of the diaphragm 110 is circumferentially attached to an inner edge of the surround 120. An inner edge of the diaphragm 110 is attached to a bobbin 150. An inner edge of the spider 125 is attached to the bobbin 150. An outer edge of the surround 120 and an outer edge of the spider 125 are attached to a basket 130. The surround 120 and spider 125 preferably restricts the movement of the diaphragm 110 along an axis of the diaphragm 110 indicated by axis 190.

Basket 130 supports a magnet 140, a pole plate 142 and a rear pole plate and pole piece 144. Bobbin 150 is disposed within an annular gap 145 formed between the pole plate 142 and pole piece 144. A wire coil 155 is wound around the bobbin 150, the bobbin and coil comprising a voice-coil, and receives an electrical signal representing an acoustic signal. The wire coil 155 generates a magnetic field in response to the applied electrical signal, which interacts with the field produced by magnet 140 causing diaphragm 110 to move in the directions indicated by axis 190.

A dust cover 115 attached to diaphragm 110 prevents particles from accumulating in the gap 145. A narrow gap is desired for a strong magnetic field in the gap. As the gap is narrowed, however, the requirements for keeping the voice-coil centered while it moves along the diaphragm axis relative to the basket increases. Keeping the voice-coil centered at tighter tolerances required by a narrower gap typically requires a stiffer surround/spider suspension system, which requires more force to move the diaphragm at frequencies below the mechanical resonance frequency of the moving structure.

In some embodiments, spider 125 is a fiber composite. The fiber may be a woven or non-woven fiber and may be a blend of fibers. Examples of fibers that may be used alone or in combination include cotton, polyester, polycotton, aramid, nylon, cellulose, polyphenylene sulfide, polyacrylonitrile, and combinations thereof. Aramids include, meta-aramids such as polymetaphenylene isophtalamides, which includes Nomex and para-aramids such as p-phenylene terephtalamides, which includes Kevlar.

The fiber composite matrix material is preferably an elastomer such as, for example, a urethane. Further examples of suitable elastomers include silicones, thermoplastic rubbers, and thermoplastic silicon vulcanizate (TPSiV) rubbers.

Figure 2:
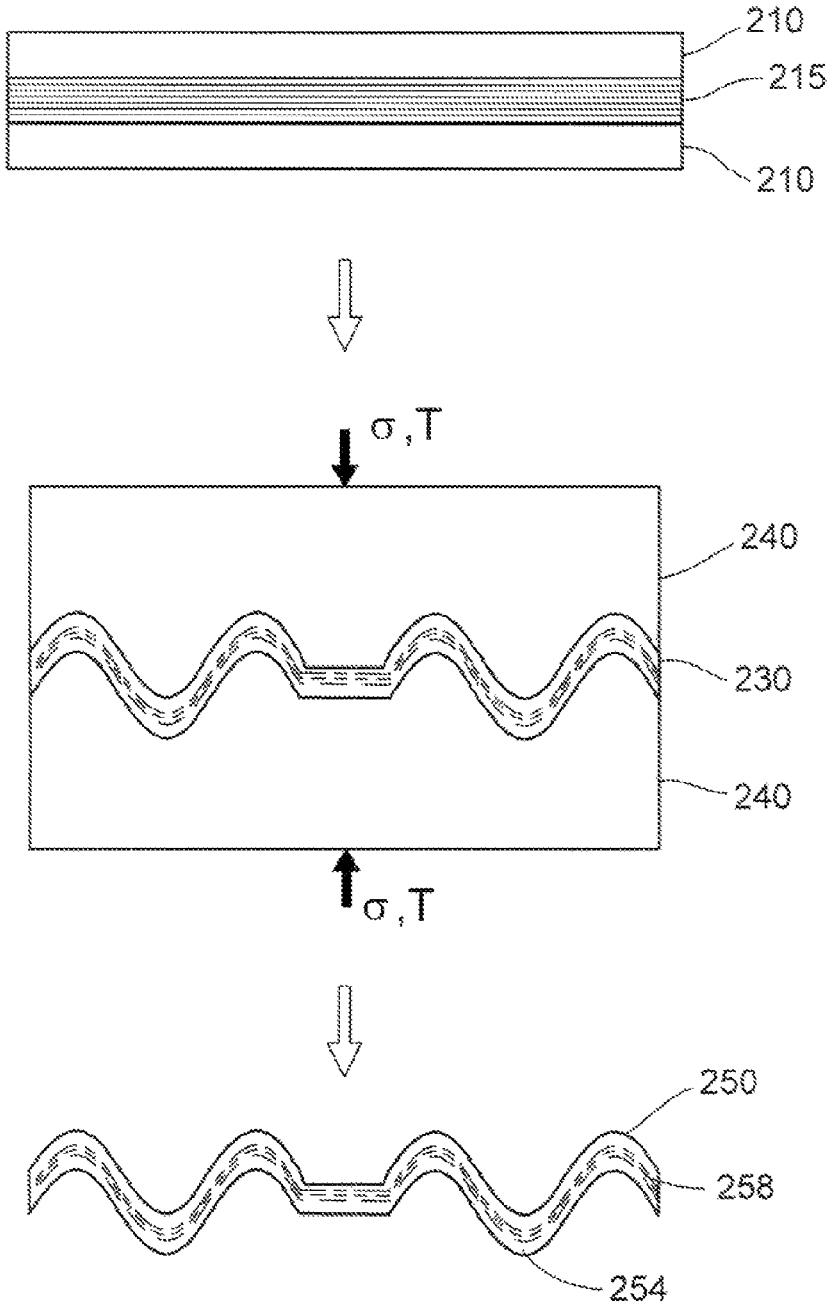
FIG. 2 is a diagram illustrating an embodiment of the present invention.

FIG. 2 is a diagram illustrating a process for forming a spider. In FIG. 2, a fiber mat 215 is sandwiched between elastomer sheets 210. The sandwich is placed in a die 240 and held at a temperature and pressure such that the elastomer sheets flow into the fiber mat and create a formed composite spider 250 comprising fibers 258 embedded in an elastomeric matrix 254. In some embodiments, the formed composite spider 250 retains a sandwich appearance in that the composite spider has an interior, fiber-rich volume between elastomer-rich external volumes that form the external surfaces of the composite spider. The fiber-rich volume may contain substantially all of the fiber with the elastomer filling the spaces between the fiber. The elastomer-rich volume is substantially all elastomer such that little or no fibers penetrate the surface of the composite spider. The sandwich may be heated indirectly through the die or directly heated by induction heating, for example. Die stops (not shown) may be used to control a thickness dimension for the formed composite.

The selection of the forming temperature and pressure typically depend on the specific elastomer selected and may be constrained by the specific fiber. For example, if the elastomer is a polyurethane such as Steven PUR MP 1880 available from JPS Elastomerics Corp. of Holyoke, Mass., forming temperatures may be selected from a range of 170-190° C. Forming pressures may be selected from the range of 2-75 MPa, preferably from the range of 4-8.5 MPa, and more preferably from the range of 6.8-8.5 MPa. Other temperatures and pressures may be selected depending on the specific elastomer selected for the matrix material.

Examples of composite spider compositions illustrating some of the variations within the scope of the present invention include: a layer of non-woven Nomex fiber sandwiched between polyurethane sheets hot pressed at 177° C. and 17 MPa; a layer of non-woven Kevlar fiber sandwiched between polyurethane sheets hot pressed at 177° C. and 17 MPA; a layer of non-woven polyester fiber sandwiched between polyurethane sheets hot pressed at 177° C. and 17 MPa; a layer of non-woven polyester fiber such as a Lutradur non-woven fiber having a density of about 5.3 oz/yd$^2$ available from Freudenberg of Durham, N.C. sandwiched between polyurethane sheets hot pressed at 179° C. and 17 MPa; a 50/50 polyester/Nomex non-woven fiber blend sandwiched between polyurethane sheets hot pressed at 188° C. and 65 MPa; and a 50/50 polyester/polyacrylonitrile non-woven fiber blend sandwiched between polyurethanes hot pressed at 188° C. and 65 MPa.

Unlike the typical spider, the elastomer matrix of embodiments of the present invention generally make such a spider air impermeable and can create a pressure imbalance between a front side of the spider and a rear side of the spider as the spider is stretched within the basket. The pressure imbalance may be reduced by providing one or more openings in the basket to allow the volumes above and below the spider to equalize their pressures. The openings may be covered with a screen to prevent dust particles from entering the volume below the spider, lodging themselves in the gap 145, and possibly affecting the performance of the electro-acoustic transducer. The dust screen adds to the cost of the electro-acoustic transducer that is not usually required in a typical spider. The added cost, however, is offset by the more desired characteristics of a fiber-elastomer composite spider. Alternatively, the spider may be vented to allow pressures on each side of the spider to equalize with each other. Vents in the spider may include holes or slits in the spider.

Figure 3:
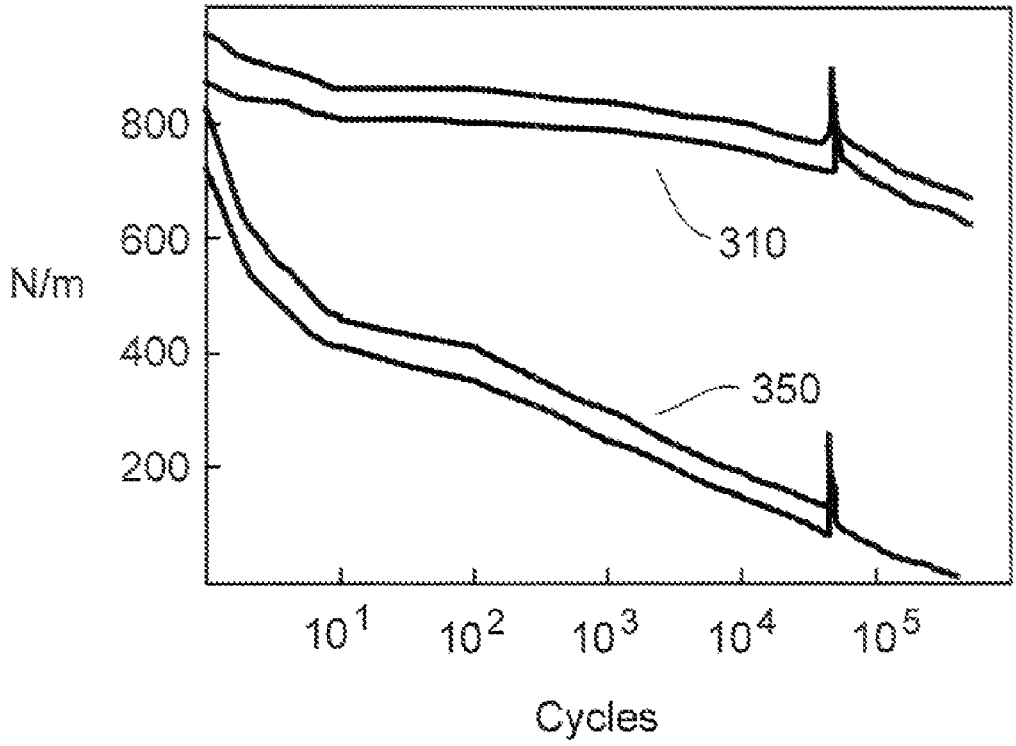
FIG. 3 is a graph of stiffness as a function of cycles for an embodiment of the present invention and for a typical spider.

FIG. 3 is a graph illustrating the stiffness of phenolic-resin-coated-fiber spider samples 350 and of fiber-elastomer composite spider samples 310. Samples of both the typical spider and elastomeric fiber composite spiders were fabricated and tested in the same fatigue testing jig. Each sample was fatigue tested under a 22 mm peak-to-peak displacement for up to 500,000 cycles. The stiffness at each cycle was calculated as an average of the upward and downward slopes of the force-deflection curve. Comparing the typical and fiber-elastomer composite samples in FIG. 3 indicates that the fiber-elastomer composite spiders retain about 80% of their original stiffness. In contrast, the typical spider retains less than about 25% of its original stiffness. The high stiffness retention exhibited by the fiber-elastomer composite spider is believed to be desirable and implies that the performance of an electro-acoustic transducer incorporating such a spider should not degrade due to degradation of the spider.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed:

1. A composite spider having a first portion attached to a basket of an electro-acoustic transducer and a second portion attached to one of a bobbin and a diaphragm of the transducer, the spider comprising a non-woven fiber mat embedded in an elastomeric matrix, wherein the non-woven fiber mat includes polyester.

2. The spider of claim 1 wherein the elastomeric matrix is impermeable to air.

3. The spider of claim 1 wherein the elastomeric matrix is a polyurethane.

4. The spider of claim 1 wherein the non-woven fiber mat is substantially all a polyester.

5. The spider of claim 1 wherein the non-woven fiber mat is a fiber blend.

6. The spider of claim 5 wherein the non-woven fiber is a blend of a polyester fiber and an aramid fiber.

7. The spider of claim 6 wherein the fraction of aramid fiber in the fiber blend is between 0.1 and 0.9.

8. The spider of claim 7 wherein the fraction of aramid fiber in the fiber blend is between 0.4 and 0.6.

9. The spider of claim 1 wherein the elastomeric matrix is selected from a group comprising a thermoplastic polyurethane, a two-part polyurethane, a silicone, a thermoplastic rubber, TPSiV, and combinations thereof.

10. The spider of claim 1 wherein the non-woven fiber is selected from a group comprising a cotton, a polyester, a nylon, a cellulose, an aramid, a polyphenylene sulfide, a polyacrylonitrile, and combinations thereof.

11. The spider of claim 5 wherein the fiber blend comprises polyester fiber and polyacrylonitrile fiber.

12. The spider of claim 5 wherein the fiber blend comprises polyester fiber and polyphenylene sulfide fiber.

13. The spider of claim 1 wherein the spider is vented.

14. The spider of claim 1 having an elastomer-rich external surface.

15. An electro-acoustic transducer comprising the spider of claim 1.

16. An electro-acoustic transducer comprising: a basket supporting a magnet; a diaphragm capable of movement relative to the basket, the diaphragm attached to a voice coil characterized by an axis, the voice coil generating a magnetic field in response to an input signal applied to the voice coil, the interaction of the generated magnetic field interacting with a magnet field of the magnet causing the diaphragm to move along the axis; a surround having a first perimeter attached to the basket and a second perimeter attached to the diaphragm at a first point along the axis; and a composite spider having a first portion attached to the basket and a second portion attached to one of a bobbin and the diaphragm at a second point along the axis, wherein the composite spider is impermeable to air.

17. The electro-acoustic transducer of claim 16 wherein the composite spider comprises a non-woven fiber.

18. The electro-acoustic transducer of claim 17 wherein the non-woven fiber is a polyester fiber.

19. The electro-acoustic transducer of claim 18 wherein the non-woven fiber is a fiber blend.

20. The electro-acoustic transducer of claim 19 wherein the non-woven fiber is a blend of a polyester fiber and an aramid fiber.

21. The electro-acoustic transducer of claim 20 wherein the aramid fiber is a meta-aramid fiber.

22. The electro-acoustic transducer of claim 20 wherein the aramid fiber is a para-aramid fiber.

23. The electro-acoustic transducer of claim 16 wherein the composite spider comprises an elastomeric matrix.

24. The electro-acoustic transducer of claim 23 wherein the elastomeric matrix is a polyurethane.

25. The electro-acoustic transducer of claim 19 wherein the non-woven fiber blend comprises a polyester fiber and a polyacrylonitrile.

26. The electro-acoustic transducer of claim 16 wherein the composite spider is characterized by a fiber-rich interior volume between elastomer-rich volumes, the elastomer-rich volumes forming external surfaces of the composite spider.

27. The electro-acoustic transducer of claim 16 wherein the composite spider is vented.

* * * * *